US007921622B2

(12) United States Patent
Bertuzzi et al.

(10) Patent No.: US 7,921,622 B2
(45) Date of Patent: Apr. 12, 2011

(54) MACHINE FOR WRAPPING GROUPS OF CIGARETTES IN PACKETS

(75) Inventors: Ivanoe Bertuzzi, Casalecchio Di Reno (IT); Luca Petrucci, Castelfranco Emilia (IT); Gilberto Spirito, Bologna (IT); Stefano Negrini, Calderara Di Reno (IT)

(73) Assignee: G.D S.p.A. (ES)

( * ) Notice: Subject to any disclaimer, the term of this patent is extended or adjusted under 35 U.S.C. 154(b) by 766 days.

(21) Appl. No.: 12/003,244

(22) Filed: Dec. 21, 2007

(65) Prior Publication Data

US 2009/0038630 A1 Feb. 12, 2009

(51) Int. Cl.
*B65B 19/10* (2006.01)
*B65B 63/00* (2006.01)

(52) U.S. Cl. ..... 53/54; 53/111 R; 53/150; 53/151; 131/283; 131/284

(58) Field of Classification Search ..... 53/54, 111 R, 53/148–151; 131/282–284
See application file for complete search history.

(56) References Cited

U.S. PATENT DOCUMENTS

| | | | | | |
|---|---|---|---|---|---|
| 394,987 | A | * | 12/1888 | Mclndoe et al. | 131/284 |
| 426,133 | A | * | 4/1890 | Le Clair | 131/284 |
| 595,866 | A | * | 12/1897 | Sullivan | 53/111 R |
| 746,376 | A | * | 12/1903 | Prescott | 131/284 |
| 1,522,545 | A | * | 1/1925 | Ratliff | 53/111 R |
| 1,915,028 | A | * | 6/1933 | Meyer-Jagenberg | 131/282 |
| 1,938,969 | A | * | 12/1933 | McKinnon | 53/111 R |
| 2,193,439 | A | * | 3/1940 | Van Doren | 131/365 |
| 2,406,675 | A | * | 8/1946 | Gallup | 131/284 |
| 4,418,705 | A | * | 12/1983 | Seragnoli | 131/84.1 |
| 4,583,558 | A | * | 4/1986 | Luke | 131/284 |
| 5,524,414 | A | * | 6/1996 | Spada et al. | 53/54 |
| 5,613,343 | A | * | 3/1997 | Inoue et al. | 53/111 R |
| 6,601,365 | B2 | * | 8/2003 | Arishiro et al. | 53/54 |
| 7,797,909 | B2 | * | 9/2010 | Ream et al. | 53/54 |
| 2004/0107674 | A1 | * | 6/2004 | von Bismarck | 53/148 |

FOREIGN PATENT DOCUMENTS

| | | | | |
|---|---|---|---|---|
| DE | 8711574 | U1 | * | 12/1987 |
| DE | 103 27 628 | A1 | | 11/2004 |
| EP | 0 764 582 | A | | 3/1997 |
| EP | 1 176 097 | A2 | | 1/2002 |
| JP | 02107178 | A | * | 4/1990 |
| JP | 03148430 | A | * | 6/1991 |

* cited by examiner

*Primary Examiner* — Stephen F Gerrity
(74) *Attorney, Agent, or Firm* — Timothy J. Klima; Shuttleworth & Ingersoll, PLC

(57) ABSTRACT

In a cigarette packer, groups of single cigarettes are first assembled by a formation unit and placed in trays carried by a conveyor, then directed in succession along a set feed path, advancing sideways-on, toward a wrapping unit by which each one is enveloped in a transparent or at least partly transparent wrapper; during the transfer from the formation unit to the wrapping unit, the trays are directed past a print unit stationed along the feed path, by which at least one graphic element such as lettering or a logo is impressed on at least one cigarette making up each group.

17 Claims, 7 Drawing Sheets

MACHINE FOR WRAPPING GROUPS OF CIGARETTES IN PACKETS

BACKGROUND OF THE INVENTION

The present invention relates to a machine for wrapping groups of cigarettes in packets.

In the following specification, the term "packet" denotes a wrapping designed to contain a group of cigarettes, or tobacco products generally.

Such packets as a rule present a substantially parallelepiped appearance and consist of a wrapper, in direct contact with the cigarettes, which may also be enclosed in a container or outer wrapper.

The outer wrapper, when of rigid type, is made up from a flat diecut blank presenting fold lines and notched cuts and can comprise, for instance, a body of cup-like appearance, a lid hinged to a back edge of the cupped body, and a frame positioned inside the selfsame cupped body, secured to a front wall and to two side walls.

The inner wrapper, in turn, is fashioned from a leaf of metallized or metal foil paper.

More and more frequently, such packets present lettering and/or graphic elements which, being of interest to the consumer, must be rendered clearly visible and localized to suit the various countries of sale and the individual brand of product.

For this reason and, where possible, to allow the use of a standard type blank for all countries, the practice is for packets of the type in question to include coupons or inserts such as cards, leaflets and the like, carrying written and pictorial information targeted at the consumer.

Conventionally, and in the case of the packets described above, such coupons are inserted between the inner wrapper and one larger side wall of the outer wrapper.

Accordingly, the aforementioned wall of the outer wrapper presents a window through which consumers are able to view the portion of the coupon on which the lettering and graphic elements are printed.

Cigarette packers require extensive modification to produce this type of packet; machines must be equipped not only with units by which the groups of cigarettes are assembled and enveloped in the inner wrapper and the outer wrapper, but also with a unit for inserting the coupons between the two wrappers.

To this must be added the costs of manufacturing and storing various types of coupon, which may be different one from another and therefore need to be changed, even with each new production cycle.

The object of the present invention is to provide a machine for wrapping groups of cigarettes in packets, such as will be unaffected by the above noted drawbacks deriving from the addition of coupons to cigarette packets.

SUMMARY OF THE INVENTION

The stated object is realized according to the present invention in a machine for wrapping groups of cigarettes in packets, comprising a formation unit by which groups of cigarettes are assembled, each consisting in at least one layer of cigarettes lying side by side, a wrapping unit by which each group is enveloped in a transparent wrapper, and a conveyor by which the groups are transferred along a predetermined feed path from the formation unit toward the wrapping unit.

The machine disclosed further comprises at least one print unit stationed along the feed path, by which a graphic element is impressed on at least one cigarette of the group.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
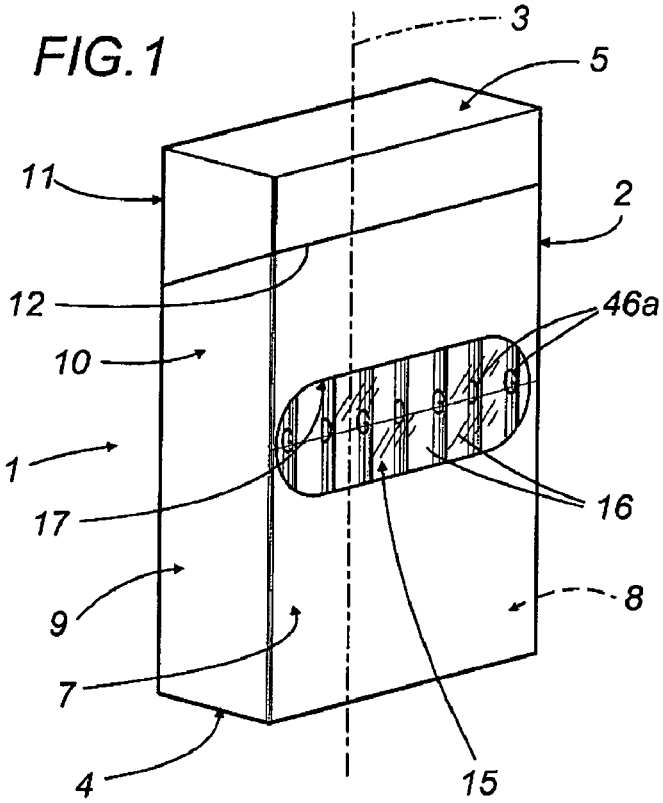
FIGS. 1 and 2 show a packet of cigarettes made by a machine according to the present invention, viewed in perspective respectively from the rear and from the front.
Figure 2:
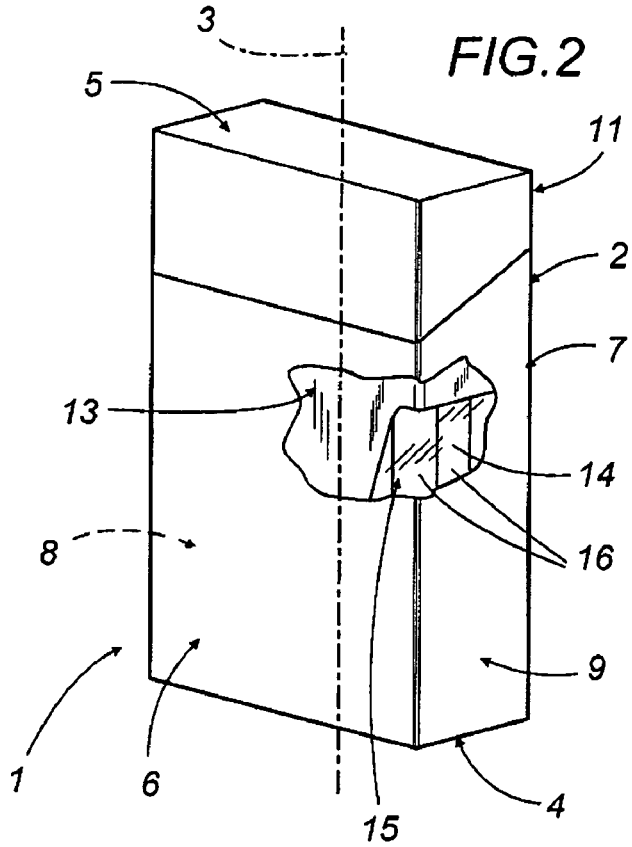

With reference to FIGS. 1 and 2, numeral 1 indicates a cigarette packet of rigid type, in its entirety, manufactured on the machine according to the present invention.

The packet 1 comprises a container or outer wrapper 2 of substantially parallelepiped shape (by way of example) referable to a longitudinal axis 3, obtained from a flat diecut blank 2*a* (see also FIG. 3) of card or paperboard, which presents a bottom wall 4 and a top wall 5 disposed transverse to the longitudinal axis 3, and four longitudinal walls arranged in two parallel pairs, a larger pair denoted 6 and 7 and a smaller pair denoted 8 and 9. The two larger walls 6 and 7 coincide respectively with the front and with the rear of the outer wrapper 2.

The container or outer wrapper 2 is composed of a cupped body 10, and a lid 11 hinged to the rear wall 7 along an edge 12 presented by the open end of the cupped body 10.

Also forming part of the outer wrapper 2 is a frame 13 located internally of the cupped body 10, fixed to the front wall 6 and the two flank walls 8 and 9, of which the function is to interact with the lid 11 in such a way that the selfsame lid will be retained correctly in a closed position.

The packet 1 also comprises an inner wrapper 14, appearing transparent at least in part and placed inside the outer wrapper 2.

The inner wrapper 14 envelops a group 15 of cigarettes 16 disposed parallel to the longitudinal axis 3 and forming a substantially parallelepiped block.

The rear wall 7 of the outer wrapper 2 affords an opening, or window 17, designed to reveal a portion of the group 15 of cigarettes 16 visible through the aforementioned transparent inner wrapper 14 beneath, and more exactly a portion of one face, presented by the cylindrical surfaces of the single cigarettes 16 making up one layer of the group adjacent to the outer wrapper 2.

Figure 3:
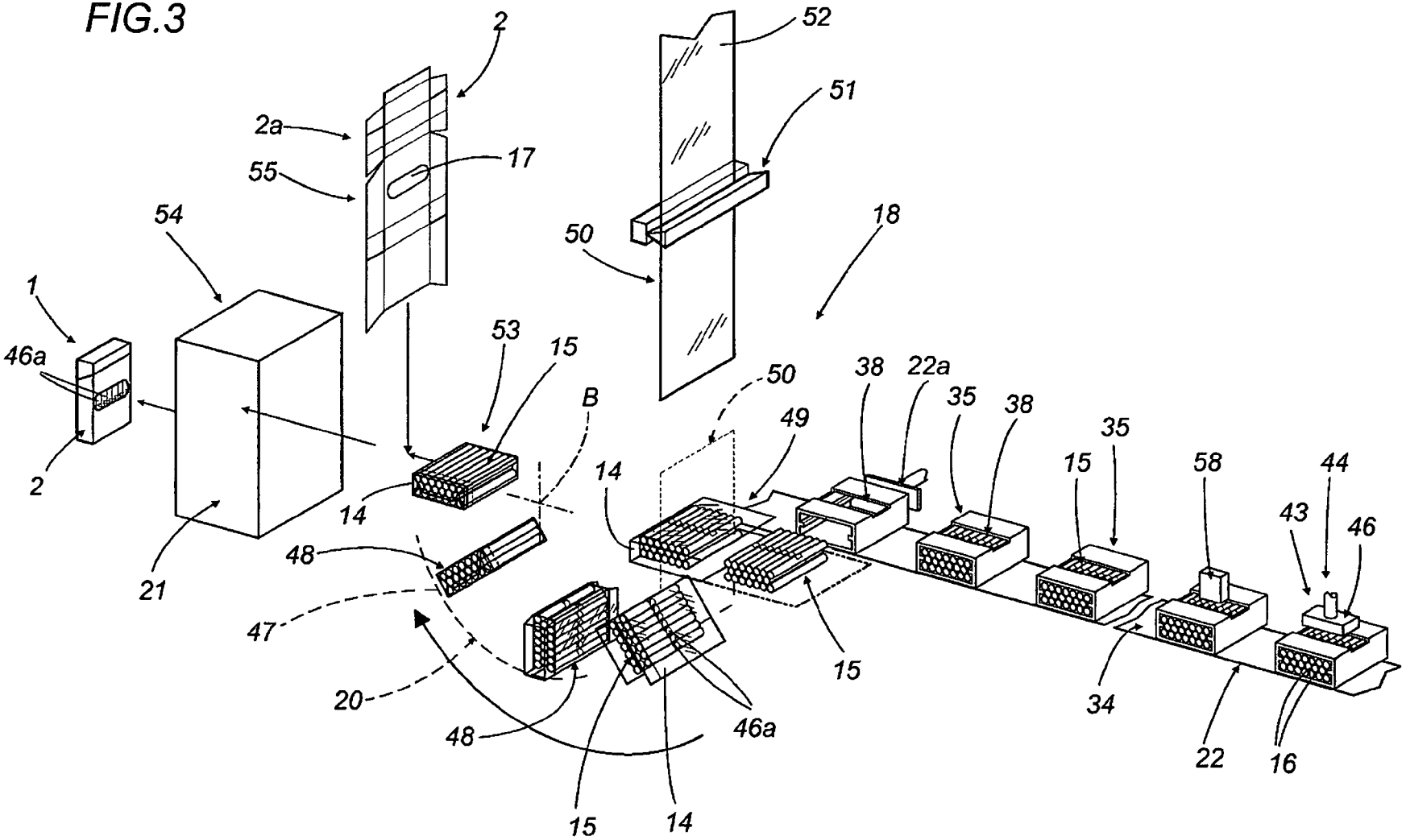
FIG. 3 shows a machine embodied according to the present invention, illustrated schematically with parts in block diagram format.
Figure 4:
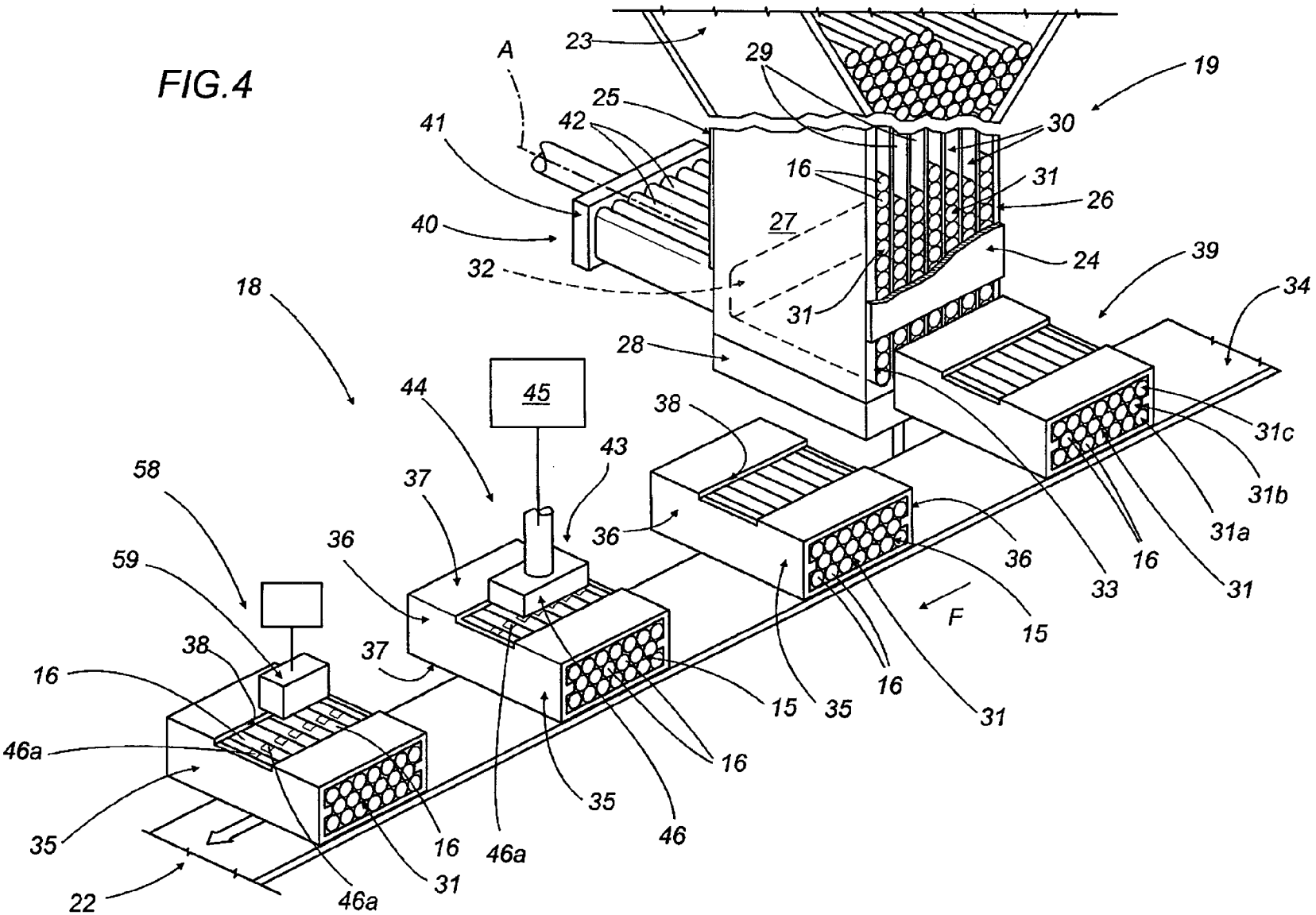
FIG. 4 shows certain details of the machine in FIG. 3, enlarged and in perspective.

Referring to FIGS. 3 and 4, numeral 18 denotes a cigarette packer, that is to say, a machine for manufacturing packets 1 of cigarettes, comprising a formation unit 19 of groups 15, each providing the contents of one packet 1.

Also forming part of the machine 18, proceeding upstream-downstream along a feed path indicated by an arrow denoted F, is a first wrapping unit 20 by which the groups 15 of cigarettes are enveloped in the transparent material of the inner wrapper 14, and a second wrapping unit 21 by which the selfsame groups 15 are enveloped in the card or paperboard outer wrapper 2.

The formation unit 19 ordering the groups 15 of cigarettes 16 is connected to the first wrapping unit 20 by way of a tray conveyor 22, on which the groups 15 are transferred.

More exactly, and in keeping with the prior art, the cigarettes 16 are ordered into groups 15 by a formation unit 19 comprising a hopper 23, of which the drawings illustrate a bottom discharge portion, or outlet, dispensing a flow of cigarettes 16 arranged horizontally one alongside another.

The hopper 23 is delimited at the front and rear by walls denoted 24 and 25 respectively, and laterally by two walls 26 and 27 disposed parallel to the axes of the cigarettes, enclosed at the bottom by a horizontal plate 28, and partitioned internally by a plurality of substantially vertical walls 29 spaced apart one from the next by a distance substantially equal to the diameter of one cigarette 16.

Accordingly, the hopper 23 is divided up into a plurality of channels 30, internally of which the cigarettes 16 form horizontal layers 31 resting on the bottom plate 28.

The front wall 24 and the rear wall 25 present respective bottom edges, lying substantially at the level of the fourth layer of cigarettes, which combine with the bottom plate 28 to create two openings denoted 32 and 33, respectively on the left and on the right as viewed in the drawings, aligned axially one with another and affording access to the inside of the hopper 23.

The aforementioned conveyor 22 operates at the bottom end of the hopper 23, on a level with the plate 28, and consists in a belt loop of which the horizontal top branch 34, illustrated in FIG. 3, is set in motion intermittently by drive means (not illustrated) along the direction of the arrow F, transversely to the axes of the cigarettes 16.

The conveyor 22 carries a number of substantially parallelepiped trays 35 spaced along its length at a predetermined pitch and designed to accommodate respective groups 15 of cigarettes 16.

The trays 35 present four walls arranged in two parallel pairs extending transversely to the top branch 34, or more exactly, two smaller vertical walls 36 and two larger horizontal walls 37, and are open at two opposite ends of which one faces the hopper 23 at the opening denoted 33.

Each tray 35 presents a substantially rectangular slot 38 occupying an intermediate position in the top horizontal wall 37, of length equal to the transverse dimension of the wall 37, and of predetermined width. In operation, the slot 38 is disposed flush with the group 15 of cigarettes 16 in the relative tray 35.

The pitch of the conveyor 22 is selected in such a way that with each step indexed, a tray 35 will move into a transfer position 39, aligned axially with the bottom outlet openings 32 and 33 of the hopper 23.

Numeral 40 denotes a transfer device positioned on the opposite side of the hopper 23 from the conveyor 22 and capable of horizontal reciprocating motion, induced by actuator means (not indicated), along an axis A parallel to the axes of the cigarettes 16.

The transfer device 40 comprises a pronged pusher denoted 41, furnished with a number of fingers 42 equal to the number of channels 30 in the hopper.

With each stroke of the transfer device 40, in conventional manner, a substantially parallelepiped group 15 of cigarettes 16 coinciding with the three bottom layers 31 inside the hopper 23, denoted 31*a*, 31*b* and 31*c* from the bottom up and consisting generally in two outer layers of seven cigarettes with an intermediate layer of six, will be directed into a tray 35 waiting at the transfer position 39.

Stationed along the feed path followed by the conveyor 22 at a position denoted 43, between the hopper 23 and the first wrapping unit 20 by which the groups 15 are enveloped in an inner wrapper 14, the machine comprises a print unit 44 shown as a controller 45 and a printing head 46, for example of laser or ink jet type, located above the conveyer and aligned on an area coinciding with the passage of the slots 38 presented by the trays 35.

Thus, each group 15 can be printed with graphic elements denoted 46*a*, stored in the controller 45, applied to a face consisting in portions of the surfaces presented by the single cigarettes 16 of the outermost layer 31*a*.

Such graphic elements 46*a* might take the form, for example, of a logo, or lettering, or a drawing. The groups 15 are transferred by a pusher 22*a* from the trays 35 to feed means of conventional type (not illustrated) serving the first wrapping unit 20, which likewise is of conventional type and consists in a wheel 47 with radial pockets 48 caused to rotate intermittently and in a clockwise direction, as viewed in FIG. 3, about an axis B parallel to the axis A aforementioned.

Each group 15 enters a pocket 48 stationed at an infeed position denoted 49, and in the process will engage a leaf 50 of transparent wrapping material separated by cutting means 51 from a continuous strip 52 decoiling from a roll (not illustrated).

As the wheel 47 indexes, the machine performs a conventional sequence of wrapping steps whereby the leaf 50 of material is folded around the group 15, which arrives ultimately at an outfeed position 53 diametrically opposed to the infeed position, fully enveloped by the inner wrapper 14.

The groups 15 of cigarettes, each in a relative inner wrapper 14, are directed by transfer means (not illustrated) to the second wrapping unit 21, indicated schematically as a block denoted 54.

Likewise performing a conventional sequence of steps, this second unit is supplied with diecut blanks 55 of card or paperboard presenting crease lines and cuts, which it proceeds to fold around the groups 15, each enveloped in a relative inner wrapper 14, and fashion into respective containers or outer wrappers 2. Each blank 55 presents the aforementioned window 17 cut from a panel that will become the rear wall 7 of the packet 1, breasted in contact with the layer 31*a* of cigarettes printed previously at the position denoted 43.

Figure 5:
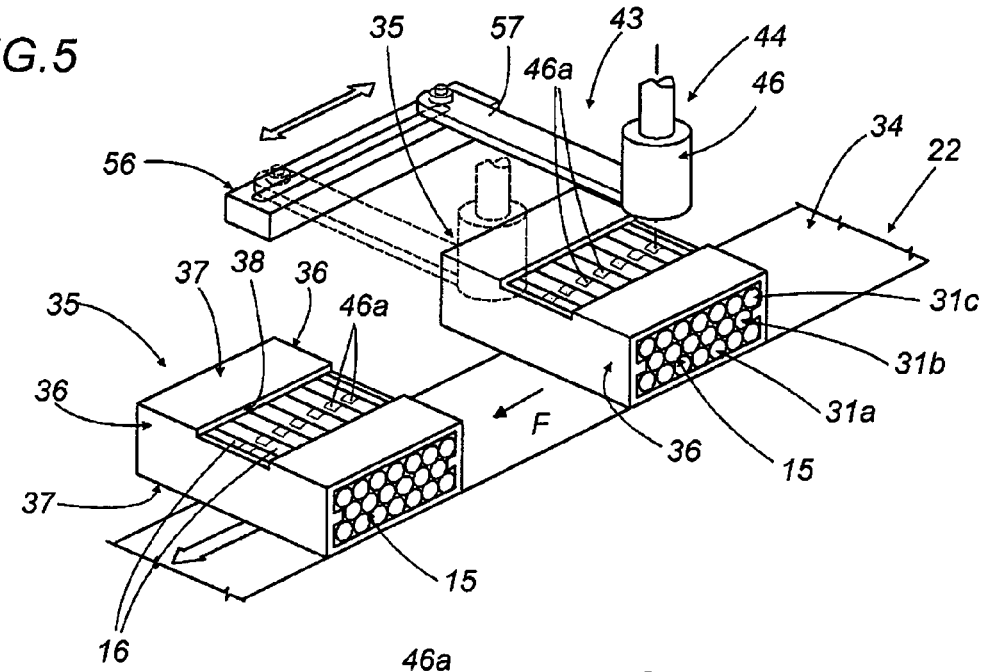
FIG. 5 shows the details of FIG. 4 in a second embodiment, viewed in perspective.

In an alternative solution to that described thus far and illustrated in FIG. 4, where the printing step is performed on the advancing groups 15 of cigarettes by a fixed print unit 44, the printing step in the example of FIG. 5 is performed on the groups 15 while stationary, by a print unit 44 capable of movement parallel with the feed path F.

In this instance the print unit 44 can be set in motion by actuator means (not illustrated) between two limit positions along a guide 56, disposed-parallel to the feed path F, to which the printing head 46 is connected by an arm 57.

Figure 6:
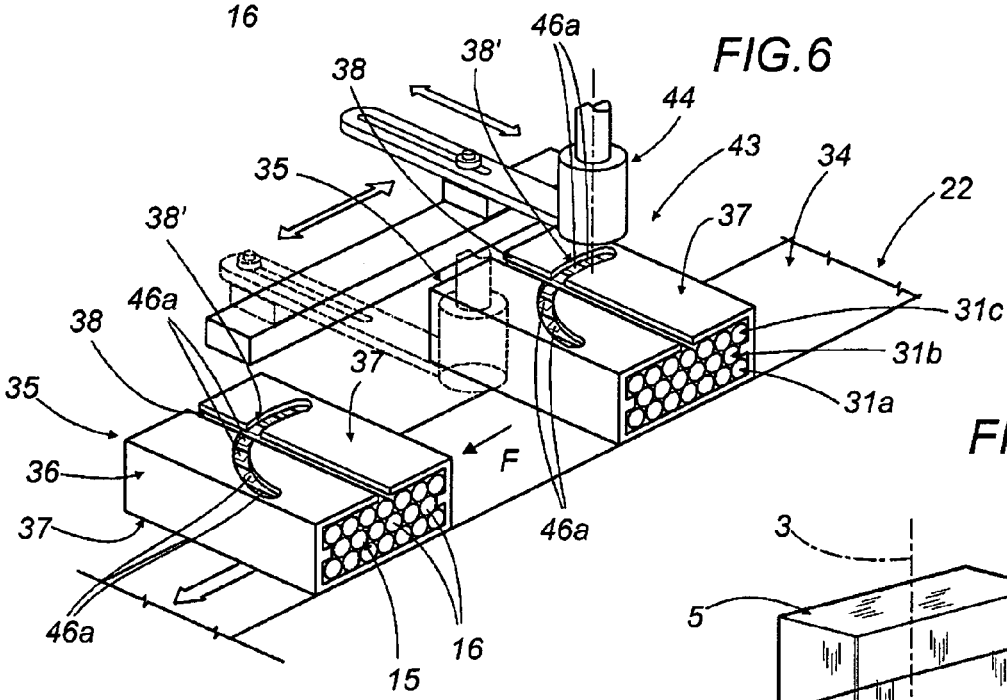
FIG. 6 shows the details of FIG. 4 in a third embodiment, viewed in perspective.
Figure 7:
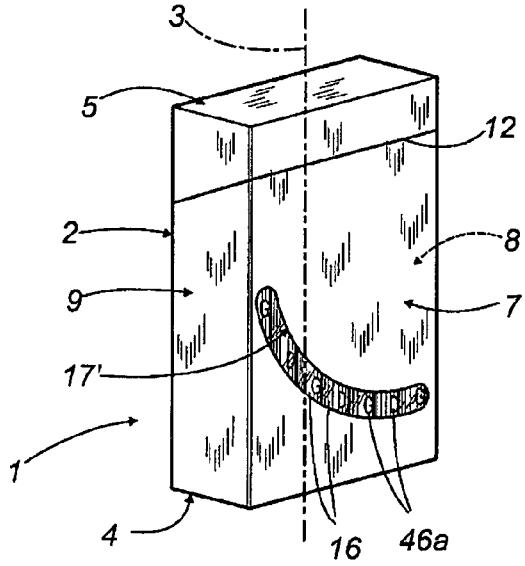
FIG. 7 shows a packet of cigarettes made by a machine incorporating the third embodiment of the details illustrated in FIG. 4.

In a further embodiment, illustrated in FIG. 6, the print unit 44 moves parallel to the feed path F as aforementioned, and is capable also of motion transverse to the selfsame path, induced by second actuator means (not illustrated).

This results in a composite motion allowing the print unit 44 to mark the layer 31*a* of cigarettes with graphic elements aligned in any given manner, such as along an arc, for example, as illustrated in FIG. 6.

In this instance, the top horizontal wall 37 of the tray 35 presents-not only a rectangular slot 38 but also a curvilinear slot 38'.

Similarly, the rear wall 7 of the single packet 1 in contact with the layer 31*a* of cigarettes will be furnished with a curved window 17' matching the layout of the graphic elements.

Figure 8:
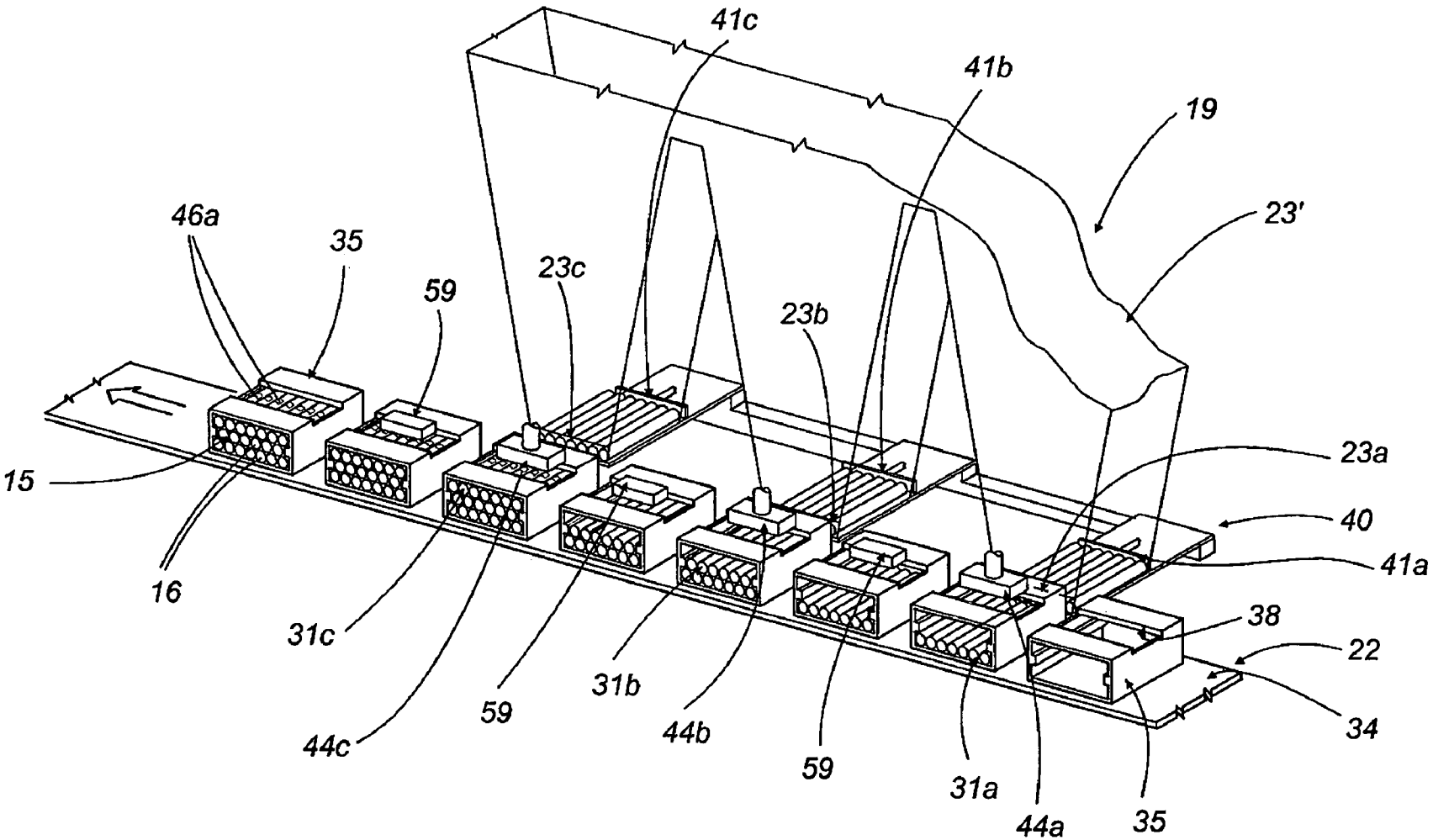
FIG. 8 shows a further embodiment of the machine according to the present invention, illustrated schematically with parts in block diagram format.

FIG. 8 shows an embodiment of the machine in which the unit 19 by which the groups 15 are formed comprises a hopper 23' of conventional type albeit differing from the hopper 23 of FIG. 4, which has a single discharge portion or outlet, in that the bottom end is split into three outlets denoted 23*a*, 23*b* and 23*c* proceeding in the upstream-downstream direction. The transfer device 40 in its turn is equipped with three pushers 41*a*, 41*b* and 41*c*, each aligned with a respective outlet 23*a*, 23*b* and 23*c*.

In this situation, again in conventional manner, the groups 15 of cigarettes are assembled by stacking the three layers 31*a*, 31*b* and 31*c* one on top of the next in sequence within the trays 35 as these are directed in succession past the three outlets 23*a*, 23*b* and 23*c*.

Where a machine utilizes a hopper 23' of this type, the possibility exists of locating a first print unit 44*a* between the first outlet 23*a* and the second outlet 23*b*, a second print unit 44*b* between the second outlet 23*b* and the third outlet 23*c*, and a third print unit 44*c* downstream of the third outlet 23*c*, to the end of printing graphic elements not only on the bottom layer 31*a* but also on the other two layers 31*b* and 31*c* of the group.

The machine could also be equipped with an inspection unit 58, such as a camera 59, for example, located downstream of the print unit 44 (FIG. 4), or downstream of each print unit 44*a*, 44*b* and 44*c* (FIG. 8).

Figure 9:
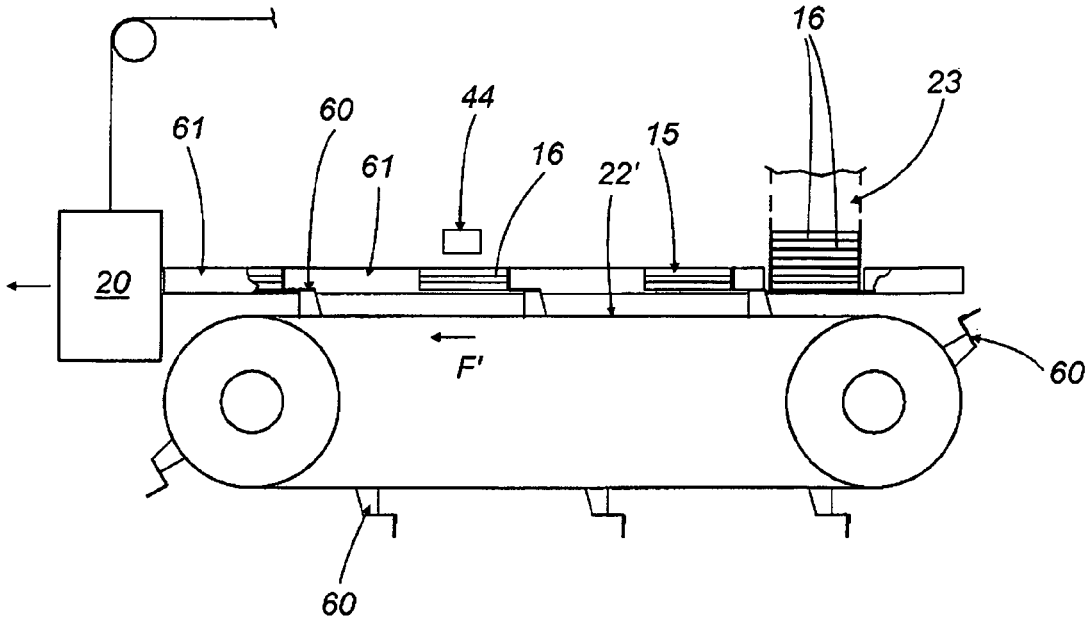
FIGS. 9 to 12 show other possible embodiments of the machine, all in accordance with the invention.

With reference to FIG. 9, the hopper 23 of the formation unit by which the groups 15 are assembled is connected to the first wrapping unit 20 by way of a looped conveyor 22' driven intermittently in the arrowed feed direction, denoted F', which in contrast to the embodiments described previously extends parallel to the axes of the cigarettes contained in the hopper 23.

Associated rigidly with the conveyor 22' at regular intervals are displacing means, denoted 60, by which a group 15 of cigarettes is taken up from the outlet of the hopper 23 with each step indexed by the conveyor and transferred along a track 61, in a direction parallel to the axes of the cigarettes, toward a print unit 44 and thereafter to the first wrapping unit 20.

Figure 10:
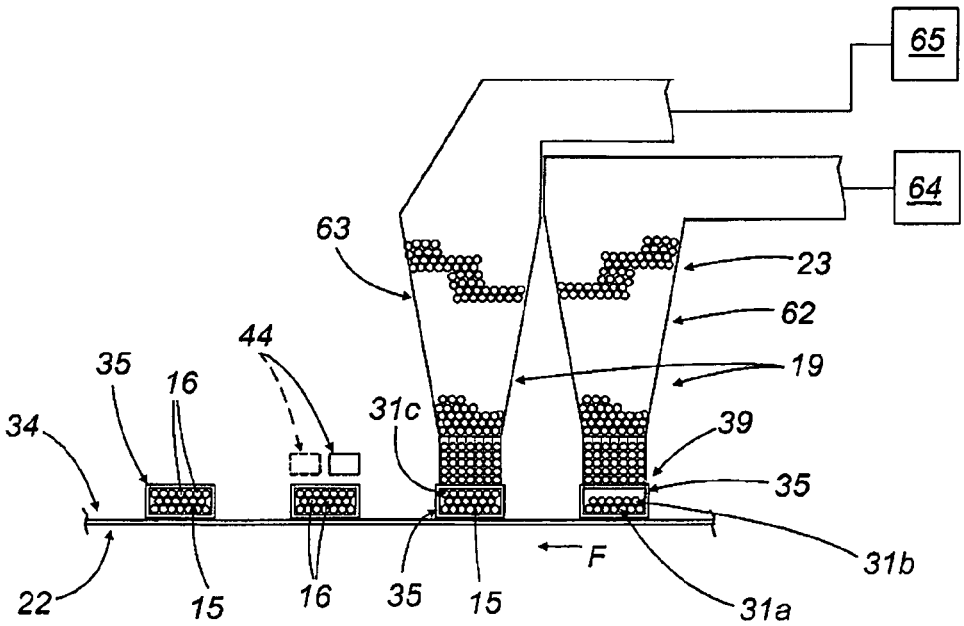

Referring to FIG. 10, the formation unit 19 by which the groups 15 are assembled comprises two hoppers 62 and 63 embodied independently one of another, installed side by side and connected to respective cigarette makers indicated schematically as blocks 64 and 65.

The two bottom layers 31*a* and 31*b* of cigarettes occupying the first hopper 62 are first directed into a respective tray 35 by transfer means (not illustrated) associated with the selfsame hopper. As the tray 35 in question then draws into alignment with the outlet of the second hopper 63, the group 15 is completed with the addition of the third layer 31*c*. The group 15 thereupon passes under the print unit 44 and proceeds toward the wrapping unit 20.

In this instance, graphic elements 46*a* can be printed on the two layers 31*a* and 31*b* that remain hidden from view when wrapped, by a print device installed on the cigarette maker 64.

Accordingly, the print unit 44 illustrated in FIG. 10 will print only the cigarettes 16 making up the layer 31*c* visible through the window 17 of the finished packet 1, which must be positioned with their cylindrical surfaces correctly oriented.

Figure 11:
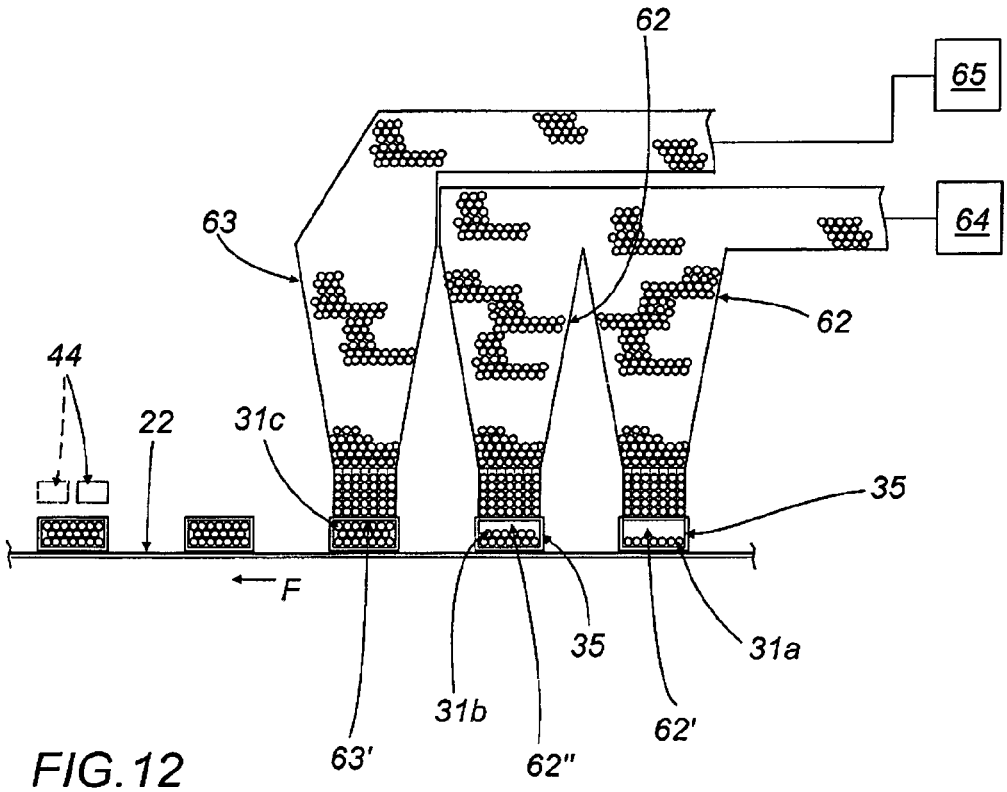

The example of FIG. 11 differs from that of FIG. 10 only inasmuch as the two layers 31*a* and 31*b* of cigarettes that either remain unprinted, or may be printed by the cigarette maker 64, are transferred to the tray 35 from two outlets 62' and 62" of the relative hopper 62.

Figure 12:
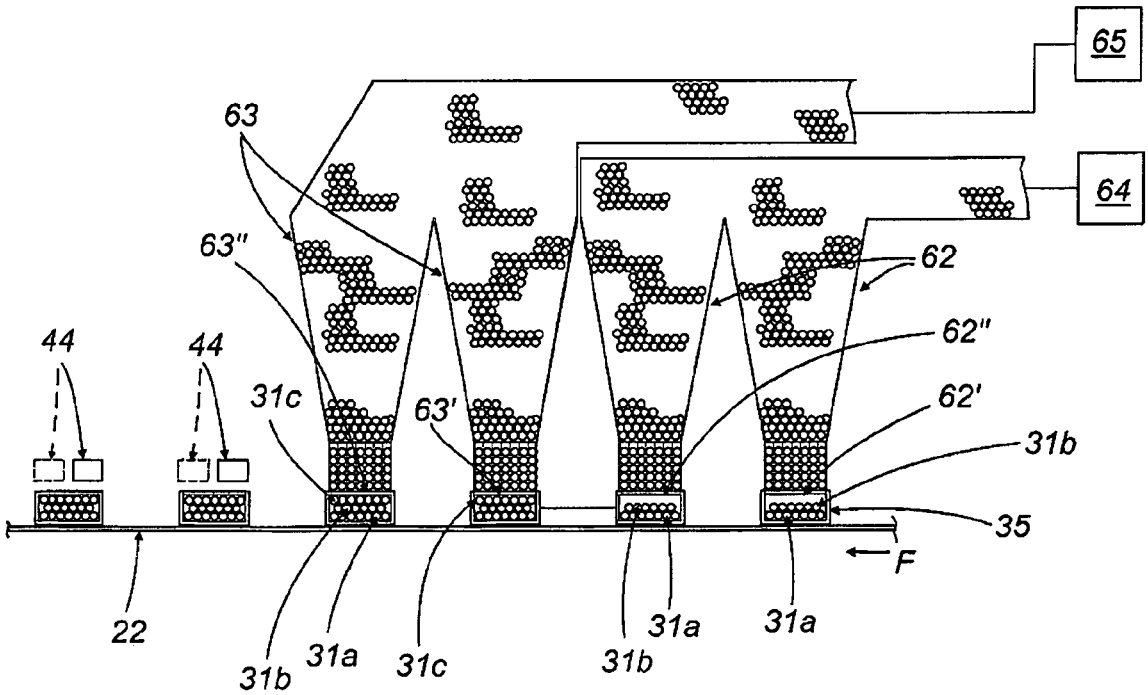

The example of FIG. 12 differs from that of FIG. 10 in that the hopper 62 providing the first two layers 31*a* and 31*b* and the hopper 63 providing the third layer 31*c* are both replaced by a hopper with two outlets of the type shown in FIG. 11, so that the hopper denoted 63 is also embodied with two outlets 63' and 63".

With this arrangement, the distance advanced intermittently by the conveyor 22 measures twice the distance covered with that of the solutions described previously, and the transfer means (not illustrated) will direct two first and second layers 31*a* and 31*b* from the outlets 62' and 62" of the first hopper 62 into two successive trays 35, at the same time as two third layers 31*c* are directed from respective outlets 63' and 63" of the second hopper 63 into two successive trays 35 already carrying two layers, to as to complete the groups 15 contained in these same two trays.

The printing step in this case can be performed by two print units 44 operating in concert during each pause in the movement of the conveyor 22.

Likewise according to the present invention, the packet 1 could be of the soft type, that is to say with an outer wrapper 2 fashioned not from a blank of rigid paper based material, but from a leaf of pliable paper affording a window 17 positioned to coincide with the graphic elements 46*a*.

Again, the packet 1 could be a single ply type, with the group 15 enveloped only by the inner wrapper 14 of transparent material.

What is claimed is:

1. A machine for wrapping groups of cigarettes in packets, comprising:

a formation unit by which groups of cigarettes are assembled, each consisting in at least one layer of cigarettes lying side by side;

a wrapping unit by which each group is enveloped in an at least partly transparent wrapper;

a conveyor by which the groups are transferred along a predetermined feed path from the formation unit toward the wrapping unit;

at least one print unit located along the feed path, by which a graphic element is printed on at least one cigarette of the group.

2. A machine as in claim 1, comprising a second wrapping unit by which each of the groups of cigarettes is enveloped in an outer wrapper presenting an opening or window positioned to coincide with at least one face of the relative group.

3. A machine as in claim 1, wherein the print unit is a laser printer.

4. A machine as in claim 1, wherein the print unit is an ink jet printer.

5. A machine as in claim 1, wherein the print unit is stationary.

6. A machine as in claim 1, wherein the print unit is capable of movement relative to the predetermined feed path.

7. A machine as in claim 6, wherein the print unit is capable of movement parallel with and/or transversely to the predetermined feed path.

8. A machine as in claim 1, wherein each group of cigarettes consists in a plurality of layers disposed one on top of another.

9. A machine as in claim 1, wherein the conveyor is capable of movement transversely to the axes of the cigarettes occupying the formation unit, and equipped with trays each accommodating a group of cigarettes and presenting a slot positioned to coincide with the area on which the graphic element is printed.

10. A machine as in claim 1, wherein groups of cigarettes are assembled by a formation unit comprising a hopper with a plurality of outlets arranged in sequence along the predetermined feed path, in such a way that a group can be formed by placing single layers one on top of another within trays of the conveyor, and operating in conjunction with at least one print unit stationed along the feed path.

11. A machine as in claim 1, wherein groups of cigarettes are assembled by a formation unit comprising a first hopper and a second hopper embodied independently of one another, from which two first layers and a final layer are directed respectively into trays of the conveyor, and operating in conjunction with at least one print unit stationed along the feed path downstream of the second hopper.

12. A machine as in claim 11, wherein the first layers are directed simultaneously into a single tray.

13. A machine as in claim 11, wherein the first hopper is furnished with two outlets, from which respective first layers of cigarettes are directed sequentially into a single tray.

14. A machine as in claim 11, wherein the first hopper and the second hopper are furnished each with two outlets, allowing two groups of cigarettes to be assembled simultaneously in two respective trays.

15. A machine as in claim 1, wherein the conveyor is capable of movement parallel to the axes of the cigarettes occupying the formation unit, and equipped with displacing means by which groups of cigarettes are directed along the feed path.

16. A machine as in claim 1, comprising an inspection unit stationed downstream of the print unit along the predetermined feed path and serving to check the quality of the graphic element.

17. A machine as in claim 16, wherein the inspection unit consists in a camera.

* * * * *